US008241151B2

(12) United States Patent
Light

(10) Patent No.: US 8,241,151 B2
(45) Date of Patent: Aug. 14, 2012

(54) COMBINATION DIVOT TOOL

(75) Inventor: Albert James Light, Winter Springs, FL (US)

(73) Assignee: I Gotcha Holdings, LLC, Winter Springs, FL (US)

( * ) Notice: Subject to any disclaimer, the term of this patent is extended or adjusted under 35 U.S.C. 154(b) by 239 days.

(21) Appl. No.: 12/816,491

(22) Filed: Jun. 16, 2010

(65) Prior Publication Data

US 2011/0312447 A1 Dec. 22, 2011

(51) Int. Cl.
*A63B 57/00* (2006.01)

(52) U.S. Cl. ..... 473/408

(58) Field of Classification Search ..... 473/408, 473/286, 406; D21/793
See application file for complete search history.

(56) References Cited

U.S. PATENT DOCUMENTS 5,295,683 A * 3/1994 Tate ..... 473/408
5,305,999 A * 4/1994 Tate ..... 473/408
6,022,280 A * 2/2000 Arenburg et al. ..... 473/408
6,033,322 A * 3/2000 England ..... 473/408
7,766,769 B2 * 8/2010 Lueders ..... 473/408
2004/0248674 A1 * 12/2004 Bauley et al. ..... 473/408
2006/0009313 A1 * 1/2006 Parks et al. ..... 473/408
2009/0239684 A1 * 9/2009 Ross et al. ..... 473/408

* cited by examiner

*Primary Examiner* — Steven Wong

(74) *Attorney, Agent, or Firm* — James H. Beusse; Beusse Wolter Sanks Mora & Maire, P.A.

(57) ABSTRACT

A golf accessory device includes a divot tool having a pair of spaced apart prongs at one end for repairing divots in a golfing surface. The tool also has an opening adjacent another end for receiving a ball marker assembly. A magnet is positioned in and circumscribes the opening. The ball marker assembly includes a ball marker and a support plate with the ball marker being magnetically attached to a first surface of the plate. A clip is attached to an opposite surface of the support plate. The marker and plate fit within the opening in the tool with an outer edge of the plate seated on the magnet. The ball marker assembly can be removed from the divot tool and attached to an item of clothing by the clip.

8 Claims, 1 Drawing Sheet

COMBINATION DIVOT TOOL

BACKGROUND OF THE INVENTION

The present invention relates to a golf accessory and especially to a golf accessory comprising a divot tool combined with a removable ball marker supported on the tool and having a separate clip for supporting the ball marker on an article of clothing.

In playing the game of golf, a golfer frequently carries a divot tool and is always expected to carry a golf ball marker. The golfer is allowed to lift the golf ball from the surface of a putting green for cleaning of the ball or to keep it from being a distraction or obstruction to other golfers. A lifted ball must, however, be marked to assure that when it is replaced it will be returned to the same spot from which it was lifted. Not only do the rules of golf permit such ball removal, it is the common practice and courtesy for the golfer to remove and mark the ball and replace it when it becomes his turn to putt. A ball marker must, however, be placed immediately behind the ball unless such placement would interfere with the play, stance or stroke of another golfer. It should then be placed one or more putter head lengths to one side. As a result of this common practice, most golfers carry a ball marker in their pocket and many simply employ a coin for this purpose. However, it is desirable for golfers in any one group to use differently identifiable markers in order to avoid confusion as to which marker is associated with a golfer's ball. A great variety of specialized ball markers have been suggested and used. A common ball marker being used is a disk about the size of a dime with a peg or prong extending axially from the planar surfaces of the disk shaped body. When using a ball marker of the usual type, a golfer laterally moves a marker to a position approximate and at least partially under the ball to insure that he does not violate the provisions of the rules relating to placing the marker immediately behind the ball. When in this position, a golfer then presses down on the ball marker to cause a peg to penetrate the surface of the putting green and thereby possibly locate the marker. This same basic marker locating technique is employed when a coin is used and, even though the coin does not have an axial peg, most golfers will press the coin down into the grass to make sure it is lying flat and that it will not be moved by the grass or present an obstruction should another golfer's ball pass over the marker when it is being putted. As the game of golf has progressed with different strains of grass on the greens that can be maintained with shorter lengths and with greater density, the need for a peg has been generally obviated and most golfers simply use a flat disk for a marker.

U.S. Pat. No. 7,070,519 is illustrative of one form of combined divot tool and ball marker used by golfers. The illustrated tool can be carried in the pocket of a golfer or in a golf bag. The divot tool has a pair of prongs for insertion in the turf for repairing ball marks in a green and includes a marker which is removably carried behind a window so that the marker is visible and easily removed for use by the golfer in marking a position of his golf ball. In the '519 patent, the marker is held in placed by raised protuberances extending into a slot through which the marker is inserted. While the combined divot tool and marker of the '519 patent is functional, it does require that the golfer retrieve the divot tool from his or her pocket in order to access the ball marker. Similarly, the divot tool must be retrieved in order to place the ball marker back into its carry or storage position.

Golfers presently prefer to carry a ball marker external of any pockets and it has become common for golfers to use a market that is magnetically attached to a clip or other device that is placed on a brim of a hat or cap. Some golf caps are even marketed with magnets sewn into the brim for the purpose of allowing a ball marker to be magnetically retained on the cap. It is also known for golfers to use a clip attached to a belt for magnetically holding a ball marker. Accordingly, it would be desirable to provide a combined divot tool and ball marker that incorporates a clip to allow the marker to be placed on a cap brim, belt or other article worn by a golfer.

BRIEF DESCRIPTION OF THE DRAWINGS

Various objects, features, and advantages of the present invention will be apparent from the written description and the drawings in which.

DESCRIPTION OF THE PREFERRED EMBODIMENT

Figure 2:
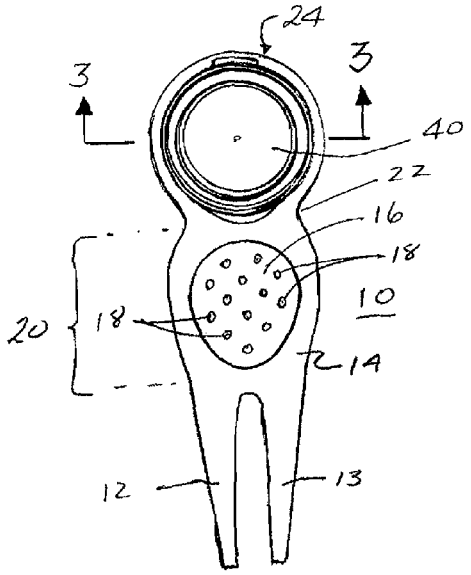
FIG. 2 is a top plan view of the golf accessory of FIG. 1 having the ball marker removed therefrom.
Figure 4:
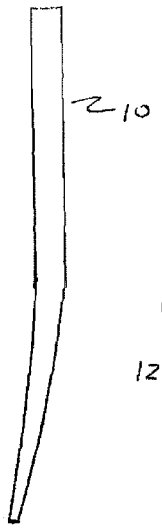
FIG. 4 is a side elevation of the golf accessory of FIGS. 1 and 2.
Figure 1:
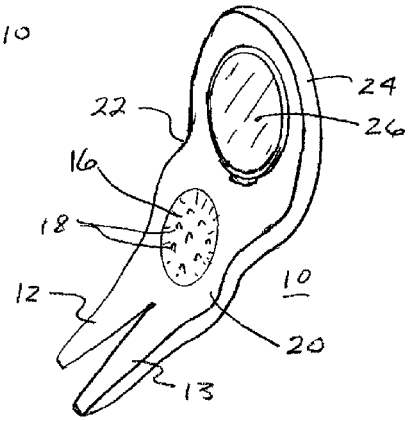
FIG. 1 is a perspective view of a golf accessory in accordance with the present invention having a ball marker therein.

Referring to the drawings, FIGS. 1, 2 and 4, a golf tool or accessory 10 has a pair of prongs 12 and 13 on one end of the accessory body 14. The prongs 12 and 13 are angled forward or curved away from the rest of the body 14, as can be more clearly seen in FIG. 4, with a slight arcuate shape. The arcuate shape improves the repair function of the tool allowing the prongs 12 and 13 to be more easily inserted into the ground under a ball mark depression (not shown, but caused by a golf ball striking a golf green from a distance) so that the depression can be repaired to a normal flat surface. To facilitate use of the tool 10, an area 16 just above the top of the prongs is hollowed out or formed into an oval depression to receive the thumb of a golfer. The area 16 may include protuberances or nodules 18 to improve traction and reduce slippage between the thumb and tool, although other forms of surface decoration may be used for the same purpose. That portion 20 of the tool 10 containing the depressed area 16 is preferably widened to further improve handling characteristics of the tool. Above the portion 20, the tool has a narrow band 22 where material has been removed both for esthetic purposes and to reduce the weight of the tool. The band 22 couples the prongs and mid-portion 20 of the tool 10 to a circular upper portion 24 that is designed to receive a golf ball marker assembly 26.

Figure 5:
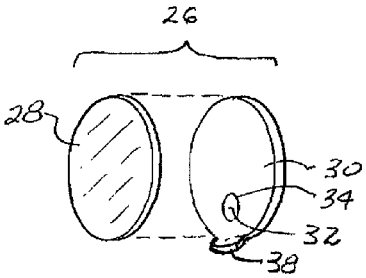
FIG. 5 is a perspective view of the ball marker shown in FIG. 1 with the associated marker retainer.
Figure 6:
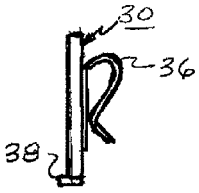
FIG. 6 is an edge view of the marker retainer of FIG. 5.
Figure 7:
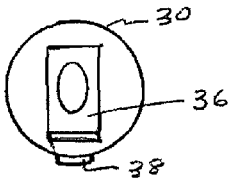
FIG. 7 is a reverse side view of the marker retainer of FIG. 5.

The golf ball marker assembly 26, shown in FIG. 5, comprises a ball marker 28 formed of a ferromagnetic material, and a support plate 30, best shown in FIGS. 6 and 7, having a permanent magnet 32 embedded in a hole 34 formed in the plate and a clip 36 attached to one side of the plate so that the plate can be clipped to an article of clothing or to a brim of a golfer's hat. The clip 36 may be a simple spring clip formed of a bent metal spring material or it may be a two part clip with a spring loaded pivoting member. The plate 30 is also formed of a ferromagnetic material and preferably includes a raised edge member 38 that acts as a guide for positioning the marker 28 on the plate where it is held in place by the magnet 32.

Figure 3:
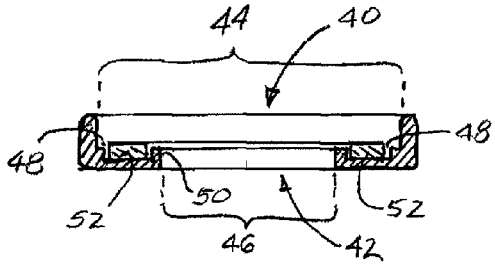
FIG. 3 is a cross-section of the upper portion of the golf accessory of FIG. 2 taken through the line 3-3.

The golf ball marker assembly 26 seats into an opening 40 in the tool upper portion 24. The top plan view of FIG. 1 and the lateral cross-sectional view of FIG. 3 shows the structure of the opening 40. In particular, the opening 40 is constructed to have a central aperture 42 passing through the portion 24. The entrance diameter 44 of the opening 40 is larger that the exit diameter 46 such that there is defined a channel or slot 48 circumscribing the opening 40 adjacent the exit diameter. The slot 48 may be milled or cast in the tool 10 and is defined by a circumferential raised edge 50 having a height about ⅓ the thickness of the tool. The slot is sized to receive a permanent, ring shaped magnet 52. The magnet 52 is preferably adhesively bonded into the slot using an epoxy resin. The dimensions of the opening 40, slot 48 and magnet 52 are selected to match the dimensions of the marker assembly 26 so that the assembly 26 can be inserted into the opening and held in place by the magnet 52 with the clip 36 extending outwardly through the exit diameter 46. This allows the clip 36 to be used to attach the tool 10 to a hat brim or other clothing article without separating the marker assembly from the tool if desired, although it is anticipated that most golfers would prefer to just remove the marker assembly from the tool during play and attach the marker assembly to an article of clothing while keeping the divot repair portion of the tool in a pocket of one's clothing.

The tool 10 provides the advantage of keeping a divot tool and a marker assembly together and reduces the trouble of having to locate each of the devices in a golfer's bag. Individually, a divot tool and a ball marker are the most common items that are misplaced by a golfer. By combining these items into a single unit that is somewhat more bulky than the items taken alone, there is an improved chance of not misplacing the items so that the items are readily available without undue searching through one's golf bag. It will be appreciated that the ball marker 28 can be imprinted on each side with various indicia that allows for unique identification of the marker, such as by imprinting the user's name on the marker. Further, advertising indicia may also be imprinted or adhered to the marker.

It should be clear at this time that a golf accessory has been provided which combines a divot tool and a removable ball marker assembly supported thereon within the body of the golf accessory. Accordingly, the present invention is to be considered illustrative rather than restrictive.

What is claimed is:

1. A golf accessory device comprising:

a divot tool having a pair of spaced apart prongs at one end for repairing divots in a golfing surface, said divot tool further having an opening adjacent another end for receiving a ball marker assembly;

a magnet positioned in and circumscribing said opening in said divot tool;

said ball marker assembly including a ball marker and a support plate, said ball marker being magnetically attached to a first surface of said support plate and a clip attached to an opposite surface of said support plate, said marker, said plate and said clip being sized to fit within said opening with at least a portion of an outer edge of said opposite surface of said plate resting on said magnet positioned in said opening, said ball marker assembly being removable from said divot tool and attachable to an item of clothing by said clip.

2. The golf accessory device of claim 1 and including a support formed within said opening for mounting of said magnet.

3. The golf accessory device of claim 2 wherein said support comprises a slot formed within and circumscribing said opening.

4. The golf accessory device of claim 3 wherein said magnet is adhesively bonded within said slot.

5. The golf accessory device of claim 4 wherein said slot is defined by an inner circumferential surface of said opening and a raised rim formed radially inward of said circumferential surface and extending about ⅓ the thickness of said tool.

6. The golf accessory device of claim 1 and including a depressed area approximately centrally located on a surface of said tool for improving control of said tool by a user.

7. The golf accessory device of claim 6 and including a plurality of raised surface nodules in said depressed area for reducing slippage of said tool.

8. The golf accessory device of claim 1 wherein said spaced apart prongs curve away from a plane of said another end of said divot tool.

* * * * *